United States Patent [19]

Shindler

[11] 4,207,883

[45] Jun. 17, 1980

[54] HOOD ASSEMBLY WITH NOISE FILTER

[75] Inventor: Harry A. Shindler, West Hartford, Conn.

[73] Assignee: Nuclear & Environmental Protection, Inc., Hartford, Conn.

[21] Appl. No.: 924,654

[22] Filed: Jul. 14, 1978

[51] Int. Cl.[2] ..... A62B 17/04

[52] U.S. Cl. ..... 128/201.22; 128/201.25

[58] Field of Search ..... 128/142.3, 142.4, 142.5, 128/142.6, 142.7

[56] References Cited

U.S. PATENT DOCUMENTS

| | | | |
|---|---|---|---|
| 2,262,522 | 11/1941 | Yant et al. | 128/142.7 X |
| 2,372,618 | 3/1945 | Vokes | 55/276 |
| 2,447,433 | 8/1948 | Schroeder | 128/142.7 X |
| 2,552,847 | 5/1951 | Farr et al. | 55/276 |
| 2,896,617 | 7/1959 | Gibbons | 128/142.7 X |
| 3,078,845 | 2/1963 | Kohlmeyer | 128/142.7 |
| 3,258,010 | 6/1966 | Austin et al. | 128/142.7 |
| 3,308,608 | 3/1967 | Brimberg | 55/276 |
| 3,308,610 | 3/1967 | Springer et al. | 55/471 |
| 3,882,961 | 5/1975 | Cannon et al. | 181/50 |
| 3,911,914 | 10/1975 | Johansson | 128/142.7 |
| 3,927,668 | 12/1975 | Raschke | 128/142.7 |
| 4,052,984 | 10/1977 | Brockway | 128/142.7 |
| 4,055,173 | 10/1977 | Knab | 128/142.7 X |
| 4,127,130 | 11/1978 | Naysmith | 128/142.3 X |

FOREIGN PATENT DOCUMENTS

| | | | |
|---|---|---|---|
| 518255 | 3/1955 | Italy | 128/142.7 |

*Primary Examiner*—Henry J. Recla

[57] ABSTRACT

An environmental control hood assembly includes a headpiece and a noise filter subassembly which is disposed within the headpiece adjacent its top wall. The filter subassembly includes a silencer member with an air-permeable wall portion and is connected to the conduit which in turn is connected to the source of air under pressure. The silencer member in turn is disposed within a foam member which is fabricated of an air-permeable synthetic resin open cell foam so that air introduced into the silencer member must travel a path through the silencer member and through the foam with resultant reduction in the sound level of that air. A barrier may be provided under the silencer to preclude direct flow of air from the silencer downwardly through the foam, and the filter subassembly may include a bottom sheet of an air-pervious material.

19 Claims, 6 Drawing Figures

HOOD ASSEMBLY WITH NOISE FILTERBACKGROUND OF THE INVENTION

In various environments such as chemical and nuclear plants, it is necessary for the employees to be protected from the atmospheric environment to avoid their breathing noxious fumes and/or particles. Moreover, in many plants the available air is sometimes at unduly high temperatures for comfortable breathing over long periods of time.

Accordingly, a number of protective hood devices have been developed and utilized to which air is supplied under superatmospheric pressure, thus protecting the employee substantially from entry of contaminated air into the hood. Such devices have proven highly effective for the purpose intended, but more recently substantial concern has developed with respect to the noise level within the hood resulting from the entry thereinto of the air under pressure. It is not uncommon for such hood assemblies to have air discharged thereinto at noise levels which exceed 60 decibels, whereas discomfort can result from continuous noise levels in excess of 12 decibels.

It is an object of the present invention to provide a novel hood assembly which effectively reduces the noise level of air supplied thereinto under superatmospheric pressure and which is comfortable for the user to wear.

It is also an object to provide such a hood assembly which may be fabricated from simply constructed components in a manner which will provide for relatively long life.

Another object is to provide such a hood assembly which may be assembled from relatively economical materials in a facile manner.

SUMMARY OF THE INVENTION

It has now been found that the foregoing and related objects may be readily attained in an environmental control hood assembly with a headpiece assembly including a headpiece dimensioned to receive the user's head therewithin and having a top wall and a sidewall. The headpiece is transparent at least about a portion of its sidewall, and there is disposed in the interior of the headpiece adjacent the top wall thereof a noise filter subassembly which includes a silencer member having an inlet at one end and an air-permeable wall portion, and a foam member encasing the silencer member and fabricated of an air-permeable synthetic resin open cell foam. Air supply conduit means is connected at one end to the inlet of the silencer member and extends outwardly of the headpiece assembly for connection to a source of air under superatmospheric pressure. Thus, air supplied to the headpiece assembly through the air supply conduit means must pass first through the air-permeable wall portion of the silencer member and thence through the air-permeable foam member with resultant reduction in the sound level and pressure of the supplied air.

In a preferred embodiment, the foam member is encased in a chamber which is pervious to air about at least a portion of the lower surface thereof. This chamber is conveniently provided by the top wall of the headpiece and a sheet of synthetic resin sheet material extending therebelow and having a multiplicity of apertures therein to render it pervious to air.

Most desirably, the filter subassembly includes a barrier member disposed between the silencer member and the underlying portion of the foam member, and this barrier member is substantially impervious to air so as to cause the supplied air to flow laterally and upwardly from the silencer member into the foam member and preclude direct passage of the air downwardly through the foam member and into the cavity defined by the headpiece. The barrier member is secured to the foam member, and there is also provided means securing the barrier member in substantially fixed relationship relative to the silencer member, to substantially preclude relative displacement. The foam member comprises a pair of disc elements adhesively engaged about the silencer member.

The air supply conduit means generally has means extending about a portion thereof inwardly of the periphery of the foam member and engaged therewith to substantially preclude relative displacement. The air supply conduit means also includes a conduit portion extending from the silencer member outwardly of the foam member and adjacent the sidewall of the headpiece and thence downwardly along and outwardly of the sidewall.

In its preferred aspect, the sidewall of the headpiece is transparent in its entirety, and the filter subassembly is secured to the top wall of the headpiece.

The silencer member is of substantially cylindrical configuration with one end thereof providing the inlet and the other end thereof has a closed wall, with the cylindrical sidewall of the silencer member being at least in part substantially pervious to air introduced thereinto. The silencer member is fabricated conveniently from synthetic resin, and has a cylindrical sidewall portion which is porous. It may include an insert of air pervious material and through which air introduced thereinto must pass to exit through the air-permeable wall portion.

DETAILED DESCRIPTION OF THE ILLUSTRATED EMBODIMENT

Figure 1:
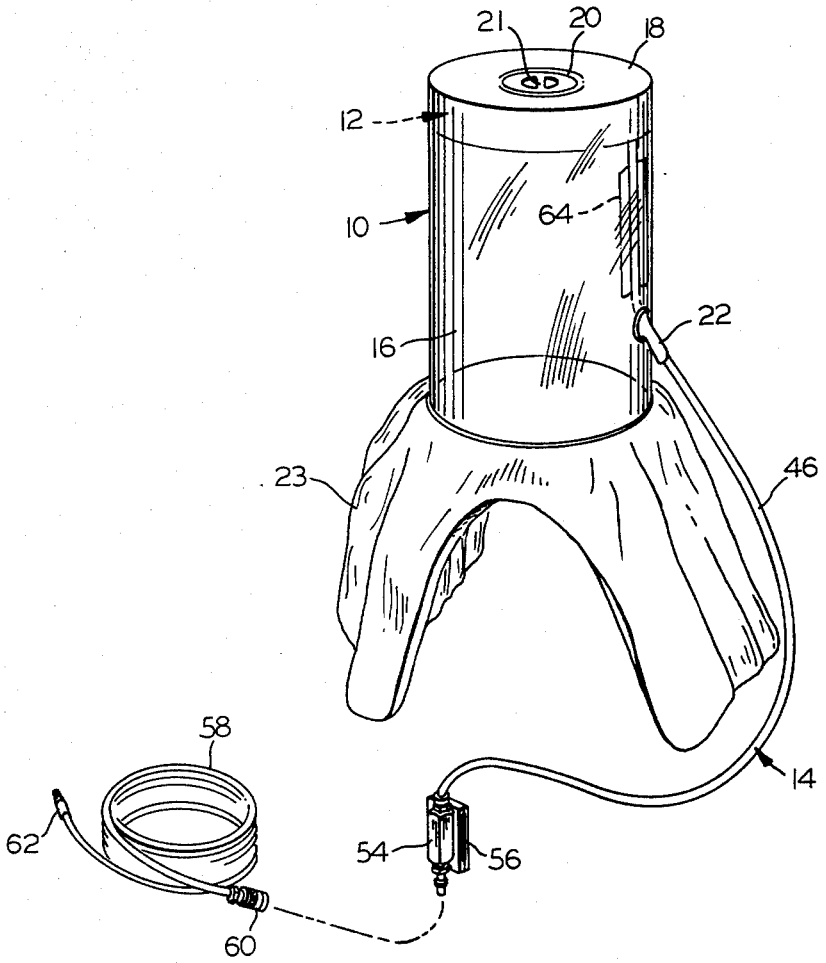
FIG. 1 is a perspective view of an environmental control hood assembly embodying the present invention with the air supply conduit means shown partially disassembled.
Figure 2:
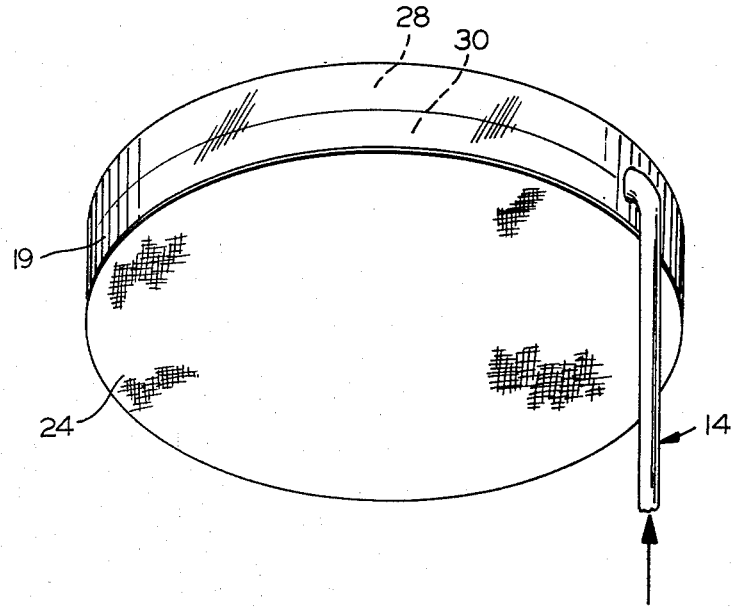
FIG. 2 is a perspective view of the filter subassembly drawn to an enlarged scale with the side and top walls of the headpiece and the conduit means shown fragmentarily.
Figure 3:
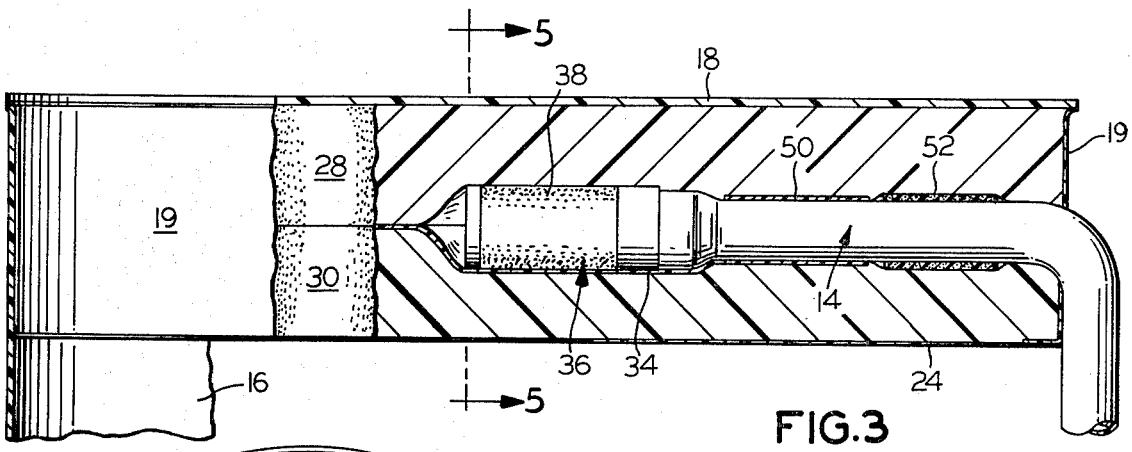
FIG. 3 is a side elevational view of the filter subassembly with portions thereof broken away at various transverse points to reveal internal construction and with the conduit means fragmentarily illustrated, the scale thereof being enlarged still further from that of FIG. 2.
Figure 4:
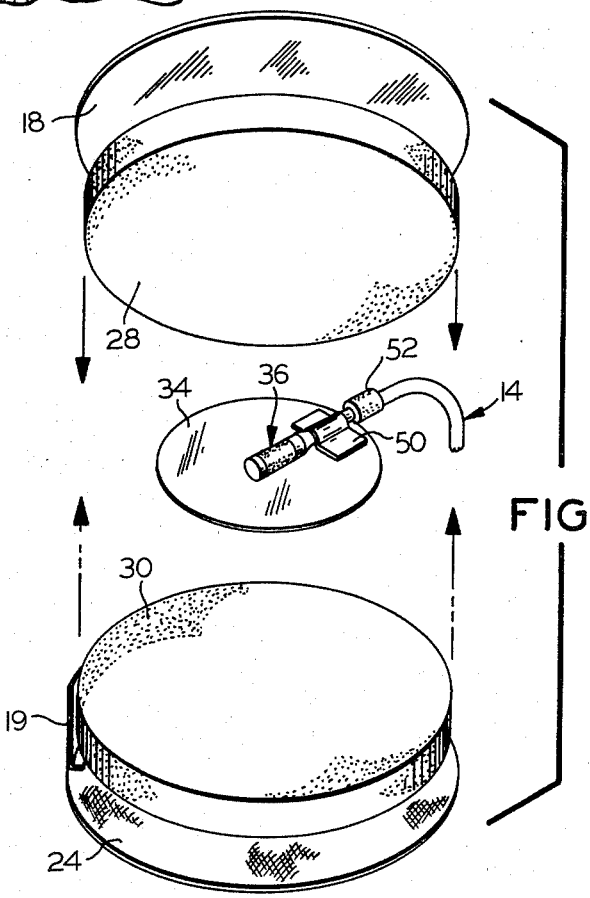
FIG. 4 is a partially exploded view of the elements in the upper portion of the headpiece assembly.
Figure 5:
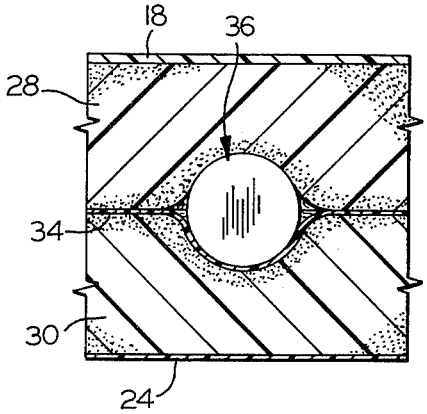
FIG. 5 is a fragmentary sectional view along the line 5—5 of FIG. 3.

Turning first to FIG. 1 of the attached drawings, therein illustrated is an environmental control hood assembly embodying the present invention and comprising a headpiece generally designated by the numeral 10, a filter subassembly generally designated by the numeral 12, and conduit means generally designated by the numeral 14. The headpiece 10 is fabricated from a cylindrical sidewall 16 of transparent synthetic resin and a top wall 18 of synthetic resin which is sealed to the upper margin of the cylindrical sidewall 16. Within an aperture in the topwall 18 is a hanger insert 20 providing a transverse bar 21 by which the hood assembly may be hung following cleaning and for storage. As best seen in FIGS. 3 and 4, the top wall 18 including a depending annular ring 19 of a diameter less than that of the transverse wall so as to accommodate the thickness of the sidewall 16 thereabout. Disposed in the sidewall 16 is a sealing sleeve 22 through which conduit means 14 extends from the interior to the exterior of the headpiece 10.

In accordance with conventional practice, there is secured to the base of the sidewall 16 a flexible cape 23 which is configured to fit conveniently about shoulders and torso of the wearer.

Turning now to the filter subassembly 12, this includes a cover sheet 24 of synthetic resin material and which is air-pervious. Conveniently, a woven vinyl chloride fabric provides the bottom wall and an extruded or calendared vinyl chloride provides the sidewall for the subassembly. Disposed therein are a pair of disc-shaped elements 28,30 fabricated of an air-permeable synthetic resin open cell foam. Disposed between the disc elements 28,30 is barrier element 34 of synthetic resin sheet material which is substantially impervious to air and disposed thereon is the silencer generally designated by the numeral 36.

Figure 6:
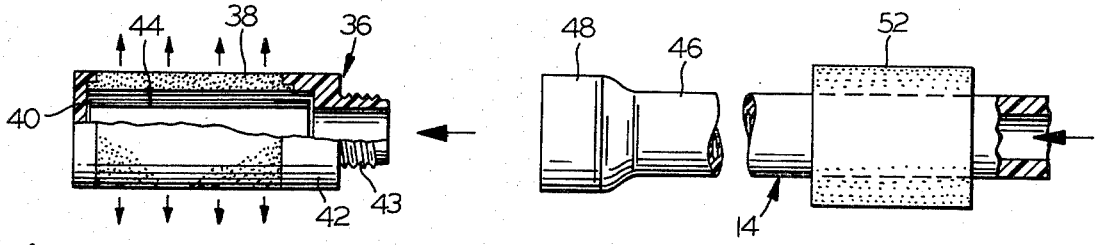
FIG. 6 is a partially exploded side elevational view of the silencer member and end portion of the conduit with portions thereof broken away or fragmented for clarity of illustration.

As best seen in FIG. 6, the silencer 36 includes a cylindrical porous sidewall portion 38, a substantially impervious end wall 40 and a substantially impervious inlet end wall 42 providing a threaded coupling 43. Disposed within the chamber of the silencer 36 is a coil 44 of air-pervious synthetic resin sheet material, the outer surface of which closely abuts the porous sidewall 38 and the inner cavity of which is substantially aligned with the inlet defined by the coupling 43.

The conduit means 14 includes a flexible conduit 46 having an end fitting 48 thereon which threadably engages the end coupling 43 of the silencer 36. Securing the end portions of the flexible conduit 46 to the barrier element 34 is an attachment strip 50 of synthetic resin sheet material which serves to maintain both the silencer 36 and conduit 46 in position within the filter subassembly since the barrier element 34 is secured in position by the adhesive sealing of the disc elements 28,30 to each other thereabout. To resist any tendency for the conduit 46 to pull outwardly of the disc elements 28,30, a collar 52 of synthetic resin foam material is disposed thereabout outwardly of the barrier element 34. This collar 52 produces displacement of the material of the disc elements 28,30 and thereby produces a mechanical interlock therewith.

The conduit 46 extends outwardly of the filter subassembly 12 and then downwardly along the interior surface of the sidewall 16 of the headpiece 10 and exits through the angled sealing sleeve 22. In accordance with general practice, it terminates in a disconnect fitting 54 attached to a hanger 56 configured to be carried by the wearer's belt. As seen in FIG. 1, the conduit means also includes a supply conduit 58 of variable length, depending upon the application and environment, with a disconnect fitting 60 at one end to cooperate with the disconnect fitting 54 and a suitable disconnect fitting 62 at its other end for coupling to the source of air under pressure. To stabilize the positioning of the conduit 46 within the headpiece 10, a retainer strip 64 of synthetic resin sheet material extends thereabout and is adhesively engaged with the sidewall 16, as shown in dotted line in FIG. 1.

As will be appreciated, the hood assembly of the present invention provides significant control over the noise level therewithin as a result of the sound transmitted along the air supply conduit. More particularly, the air supplied to the headpiece 10 through the conduit means 14 first discharges into the silencer 36 and must pass through the coil 44 before it may exit through the porous sidewall 38 thereof. The baffling effect provided by the coil 44 and the sound absorbing effect of both the coil 44 and the porous sidewall 38 produces a very significant reduction in the level of sound of the air passing therethrough.

As the air exits through the porous sidewall 38, it may not pass directly downwardly into the interior space of the headpiece 10 because of the air-impervious barrier member 34. As a result, the air is caused to flow both sideways and upwardly within the foam disc elements 28,30 and thereby a tortuous path to the lower surface of the lower foam disc element 30 from which it may be discharged. This tortuous passage produces still further sound absorption within the foam material. Lastly, the air issuing from the lower surface of the lower foam disc element 30 must pass through the air-pervious cover sheet 24 which produces still further sound absorption. As a result of these several synthetic resin members through which the air must pass, it will be appreciated that significant absorption of the sound is produced.

In the illustrated embodiment, the silencer is fabricated in its entirety of synthetic resin, with the end elements being of relatively impervious synthetic resin and the cylindrical sidewall being of porous synthetic resin construction. If so desired, the silencer member in its entirety may be fabricated of a porous or air-pervious synthetic resin material. Moreover, porous metals may also be employed if so desired. Alternatively, the silencer may comprise a series of baffle sleeves which cause the air to follow a tortuous path therethrough over surfaces which will produce absorption of sound.

The synthetic resin foam disc elements are comprised of an open cell foam material to permit passage of the air therethrough without undue pressure drop. In its preferred form, the foam is a flexible foam to facilitate assembly and eliminate the necessity for fabricating recesses for the silencer, conduit, etc.; however, a rigid foam material may be used if so desired. Although the filter assembly has been shown as comprised of two foam disc elements, it may be fabricated as a single element by foaming the resin in place about the remaining elements in a suitably configured mold, or it may be constructed of three or more elements.

The barrier element below the silencer has been shown as a separate piece of synthetic resin sheet material which is substantially impervious to air. It may be comprised of other materials such as metal and ceramics if so desired. Moreover, an air-impervious portion may be provided in the foam disc assembly by collapsing the foam or by impregnating it with a barrier material.

The cover sheet is shown in the illustrated embodiment as provided by woven synthetic resin sheet material which is inherently porous by reason of the woven construction. Alternatively, the desired degree of air porosity may be provided by an extruded or calendared porous material or by perforating such extruded or calendared sheet material. Moreover, although the preferred cover sheet is a flexible member to facilitate fabrication and assembly, it may be a rigid molded member providing the desired porosity by reason of the inherent nature of the resin employed, or it may be perforated to provide the necessary air permeability.

The headpiece is shown as fabricated from a cylindrical sidewall, a separate top wall and an insert hanger element for that top wall. If so desired, the entire structure may be integrally formed by molding. Moreover, although conveniently the entire sidewall portion of the headpiece is fabricated from transparent resin, it may be desired to fabricate the sidewall from more than one element with a transparent window providing sufficient peripheral visibility. In the illustrated embodiment, a satisfactory degree of heat sealing of the top wall to the sidewall is provided, but the area may be increased by means of interfitting lips on one or both members. Moreover, in place of heat sealing, adhesive sealing may be achieved by other techniques such as solvent fusion, ultrasonic welding and applied adhesives.

The elongated conduits of the conduit means are desirably fabricated from highly flexible synthetic resins. Although disconnects have been shown at belt level and at the point of coupling to the source of air, it will be appreciated that a disconnect fitting may also be employed at the sealing tube where the conduit exits the headpiece.

The cape which is shown in FIG. 1 is readily secured to the base of the headpiece by heat sealing, adhesives or other suitable means. It can be detachably secured if so desired through conventional forms of attachment at spaced points or entirely about the periphery of the sidewall. Moreover, the cape may be comprised of a series of layers of flexible material to increase the quality of the seal about the upper portion of the torso of the wearer and may in fact include means for effecting some form of mechanical seal with clothing worn by the user.

Of the various resins that may be employed, vinyl chloride homopolymers and interpolymers have proven highly efficient for the manufacture of the foam disc elements, the headpiece elements and the cover sheet. However, other suitable resins include polycarbonates, polyethylene, and polypropylene when transparency is required coupled with flexibility or formability. Depending upon the intended use and the method of fabrication, still other synthetic resins may be employed if so desired. The silencer member is conveniently fabricated from polyolefins such as polyethylene, although other synthetic resins may also be employed therefor.

In assembling the illustrated embodiment, the cover sheet is desirably fabricated from an essentially circular piece of woven vinyl chloride fabric and a length of tubular vinyl chloride(calendared or extruded)sheet material which are heat sealed together. The silencer and foam disc elements are assembled within the cover sheet, and the conduit is led outwardly through an aperture in the sidewall of the cover sheet. This subassembly is placed within the upper portion of the cylindrical wall for the headpiece and the conduit is led downwardly along the sidewall and outwardly through the sealing tube. The upper edge portion of the sidewall of the cover sheet is folded over the upper edge of the sidewall and the top wall is placed thereon. Through suitable apparatus, the top wall, upper edge of the cylindrical sidewall and cover sheet are sealed together.

It will be appreciated that variations of the above technique may be employed depending upon the sealing apparatus available and the desirability of employing other configurations. For example, a ring may be added to the assembly to capture the upper end of the sidewall of the cover sheet between it and the upper portion of the headpiece sidewall, with the seal being effected laterally between the several elements. This seal may be made by a layer of adhesive, solvent sealing, or ultrasonic welding.

Illustrative of assemblies embodying the invention is the following specific construction. The silencer employed is one manufactured and sold by Lehigh Fluid Power, Inc. of Lambertville, New Jersey under the designation COMPACTAIRE having a diameter of ¾ inch and a length of 2 ⅛ inch and fabricated from polyethylene components including a porous polyethylene cylindrical sidewall portion. This has been found to produce a 15 percent maximum flow restriction at any pressure.

The foam discs are fabricated of an open cell polyvinyl foam and have a diameter of approximately 10 inches and a thickness of about one inch each. A suitable material is sold by Tenneco General Foam Division and exhibits a 10 percent maximum flow restriction under any pressure. The cover sheet is fabricated from a woven vinyl chloride bottom wall having a diameter of about 10 inches and a tubular sidewall of extruded vinyl chloride sheet material having a height of about 2 ⅛ inches.

The headpiece itself includes a cylindrical sidewall member of transparent vinyl chloride sheet material of approximately 0.020 inch thickness. An advantageously employed material is calendared and press polished vinyl chloride. The same material is conveniently employed for the top wall of the headpiece.

After assembly as hereinbefore indicated, it is found that air supplied from conventional pressure sources and exhibiting a sound level in excess of 60 decibels at the end of a given length of conduit is reduced to levels below 12 decibels even at rates of not less than 6 cubic feet per minute, and without significant effect from the length of hose.

Thus, it can be seen from the foregoing detailed specification and attached drawings that the hood assembly of the present invention is one which may be readily fabricated from durable materials to provide significant reduction in the sound level of the air being supplied without excessive pressure drop.

Moreover, the hood assembly may be readily fabricated from relatively economical materials and is relatively free from interference with the normal breathing and activities of the wearer.

Having thus described the intention, I claim:

1. In an environmental control hood assembly, the combination comprising:

A. a headpiece assembly including 1. a headpiece dimensioned to receive the user's head therewithin and having a top wall and a sidewall, said headpiece being transparent at least about a portion of the sidewall thereof, said headpiece including a support member having a surface positioned below and in spaced relationship to said top wall to define a chamber therebetween, said support member being secured to a wall of said headpiece and being pervious to air about at least a portion of the surface thereof to permit air to flow from said chamber into the remainder of the space defined by said headpiece;

2. a noise filter subassembly disposed in said chamber and including
   a. a silencer member having an inlet at one end, a closed wall at the opposite end and an air-permeable wall portion therebetween;
   b. a foam member encasing said silencer member and fabricated of an air-permeable synthetic resin open cell foam;

B. air supply conduit means connected at one end to said inlet of said silencer member and extending outwardly of said headpiece assembly for connection to a source of air under superatmospheric pressure, whereby air supplied to said headpiece assembly through said air supply conduit means must pass first through said air-permeable wall portion of said silencer member and thence said air-permeable foam member with resultant reduction in the sound level of the supplied air.

2. The hood assembly of claim 1 wherein said chamber is provided by the top wall of said headpiece and a sheet of synthetic resin material extending below said top wall in spaced relationship thereto to define a chamber therebetween, said sheet being secured to a wall of said headpiece about its periphery and having a multiplicity of apertures therein to render it pervious to air.

3. The hood assembly of claim 1 wherein said filter subassembly includes a barrier member disposed between said silencer member and the underlying portion of said foam member, said barrier member being substantially impervious to air so as to cause the supplied air to flow laterally and upwardly from the silencer member into the foam member and preclude direct passage of the air downwardly through the foam member and into the cavity defined by the headpiece.

4. The hood assembly of claim 3 wherein said barrier member is secured to said foam member and there is provided means securing said barrier member in substantially fixed relationship relative to said silencer member, whereby relative displacement is substantially precluded.

5. The hood assembly of claim 3 wherein said foam member comprises a pair of disc elements adhesively engaged about said silencer member.

6. The hood assembly of claim 1 wherein said air supply conduit means has means extending thereabout inwardly of said foam member and engaged therewith to substantially preclude relative displacement.

7. The hood assembly of claim 1 wherein said air supply conduit means includes a conduit portion extending from said silencer member outwardly of said foam member adjacent said sidewall of said headpiece and thence through said sidewall and downwardly therealong.

8. The hood assembly of claim 1 wherein said sidewall of said headpiece of transparent in its entirety.

9. The hood assembly of claim 1 wherein said filter subassembly is secured to said top wall of said headpiece.

10. The hood assembly of claim 1 wherein said silencer member is of substantially cylindrical configuration with one end thereof providing said inlet and the other end thereof having a closed wall, the cylindrical sidewall of said silencer member being at least in part substantially pervious to air introduced thereinto.

11. The hood assembly of claim 10 wherein said silencer member is fabricated from synthetic resin.

12. The hood assembly of claim 11 wherein said cylindrical sidewall includes a portion which is porous.

13. The hood assembly of claim 10 wherein said silencer member includes an insert of air-pervious material and through which air introduced thereinto must pass to exit through said air-permeable wall portion.

14. In an environmental control hood assembly, the combination comprising:

A. a headpiece assembly including
   1. a headpiece dimensioned to receive the user's head therewithin and having a top wall and a sidewall, the sidewall of said headpiece being transparent;
   2. a noise filter subassembly disposed in the interior of said headpiece and secured to said top wall thereof, said filter subassembly including
      a. a silencer member having an inlet at one end a closed opposite end and an air-permeable wall portion therebetween;
      b. a foam member encasing said silencer member and fabricated of an air-permeable synthetic resin open cell foam;
      c. a barrier member disposed between said silencer member and the underlying portion of said foam member, said barrier member being substantially impervious to air so as to cause the supplied air to flow laterally and upwardly from the silencer member into the foam member and preclude direct passage of the air downwardly through the foam member and into the cavity defined by the headpiece;

B. air supply conduit means connected at one end to said inlet of said silencer member and extending outwardly of said headpiece assembly for connection to a source of air under superatmospheric pressure, whereby air supplied to said headpiece assembly through said air supply conduit means must pass first through said air-permeable wall portion of said silencer member and thence said air-permeable foam member with resultant reduction in the sound level of the supplied air.

15. The hood assembly of claim 14 wherein said filter subassembly includes an envelope encasing said cam member and pervious to air about at least a portion thereof.

16. The hood assembly of claim 15 wherein said barrier member is secured to said foam member and there is provided means securing said barrier member in substantially fixed relationship relative to said silencer member, whereby relative displacement is substantially precluded.

17. The hood assembly of claim 15 wherein said silencer member is of substantially cylindrical configuration with one end thereof providing said inlet and the other end thereof having a closed wall, the cylindrical sidewall of said silencer member being at least in part substantially pervious to air introduced thereinto.

18. In an environmental control hood assembly, the combination comprising:

A. a headpiece assembly including
   1. a headpiece dimensioned to receive the user's head therewithin and having a top wall and a sidewall, said headpiece being transparent at least about a portion of the sidewall thereof, said headpiece including a sheet of synthetic resin sheet material having a surface positioned below and in spaced relationship to said top wall to define a chamber therebetween, said support member being secured to a wall of said headpiece and having a multiplicity of apertures therein to render it pervious to air to permit air to flow from said chamber into the remainder of the space defined by said headpiece;

2. a noise filter subassembly disposed in said chamber and including
   a. a silencer member having an inlet at one end, a closed wall at the opposite end and an air-permeable wall portion therebetween;
   b. a foam member encasing said silencer member and fabricated of an air-permeable synthetic resin open cell foam;

B. air supply conduit means connected at one end to said inlet of said silencer member and extending outwardly of said headpiece assembly for connection to a source of air under superatmospheric pressure, whereby air supplied to said headpiece assembly through said air supply conduit means must pass first through said air-permeable wall portion of said silencer member and thence said air-permeable foam member with resultant reduction in the sound level of the supplied air.

19. In an environmental control hood assembly, the combination comprising:

A. a headpiece assembly including
   1. a headpiece dimensioned to receive the user's head therewithin and having a top wall and a sidewall, said headpiece being transparent at least about a portion of the sidewall thereof, said headpiece including a support member having a surface positioned below and in spaced relationship to said top wall to define a chamber therebetween, said support member being secured to a wall of said headpiece and being pevious to air about at least a portion of the surface thereof to permit air to flow from said chamber into the remainder of the space defined by said headpiece;
   2. a noise filter subassembly disposed in the interior of said headpiece adjacent said top wall thereof and said chamber and including
      a. a silencer member having an inlet at one end, a closed wall at the opposite end and an air-permeable wall portion therebetween;
      b. a foam member encasing said silencer member and fabricated of an air-permeable synthetic resin open cell foam;
      c. a barrier member disposed between said silencer member and the underlying portion of said foam member, said barrier member being substantially impervious to air so as to cause the supplied air to flow laterally and upwardly from said barrier member into said foam member and preclude direct passage of the air downwardly through the foam member and into the cavity defined by the headpiece;

B. air supply conduit means connected at one end to said inlet of said silencer member and extending outwardly of said headpiece assembly for connection to a source of air under superatmospheric pressure, whereby air supplied to said headpiece assembly through said air supply conduit means must pass first through said air-permeable wall portion of said silencer member and thence said air-permeable foam member with resultant reduction in the sound level of the supplied air.

* * * * *

UNITED STATES PATENT AND TRADEMARK OFFICE

CERTIFICATE OF CORRECTION

PATENT NO. : 4,207,883

DATED : June 17, 1980

INVENTOR(S) : HARRY A. SHINDLER

It is certified that error appears in the above-identified patent and that said Letters Patent are hereby corrected as shown below:

Column 8, line 44, "cam" should be -- foam --

Column 8, lines 47 and 53, "Claim 15" should read -- Claim 14 --.

Signed and Sealed this

*Ninth* Day of *September 1980*

[SEAL]

*Attest:*

SIDNEY A. DIAMOND

*Attesting Officer*

*Commissioner of Patents and Trademarks*